US005692654A

United States Patent [19]

Bell

[11] Patent Number: 5,692,654

[45] Date of Patent: Dec. 2, 1997

[54] SLING AND ACCESSORY ATTACHMENT SYSTEM

[76] Inventor: Dennis L. Bell, 15519 Hwy. 392, Greeley, Colo. 80631

[21] Appl. No.: 704,409

[22] Filed: Aug. 23, 1996

[51] Int. Cl.[6] ..... F41C 23/02; F41C 33/00

[52] U.S. Cl. ..... 224/150; 224/257; 42/85; 24/2.5; 24/593; 24/590

[58] Field of Search ..... 224/150, 908, 224/909, 257, 910; 42/85; 24/2.5, 265 AL, 590, 593; 410/101, 106, 107; 248/499, 100

[56] References Cited

U.S. PATENT DOCUMENTS 2,078,010 4/1937 Meepos ..... 42/85

3,061,965 11/1962 Lewis ..... 42/85

4,823,491 4/1989 Llames ..... 42/85

*Primary Examiner*—Henry J. Recla

*Assistant Examiner*—Timothy L. Maust

*Attorney, Agent, or Firm*—Michael A. Capraro

[57] ABSTRACT

An improved sling and accessory attachment system for use on a firearm, camera and similar objects. The sling and accessory attachment system is comprised of a fitted, flush mounted anchor and removable external attaching members, one removable external attaching member fitted with a pivotal loop for attaching a sling or strap and another removable external attaching member capable of receiving a bipod or other accessory. The anchor receives and holds the removable external attaching member which is then rotated to a fixed stop and positively locked in place by a slideable pin. The removable external attaching member is quickly connected and quickly disconnected from the anchor.

21 Claims, 3 Drawing Sheets

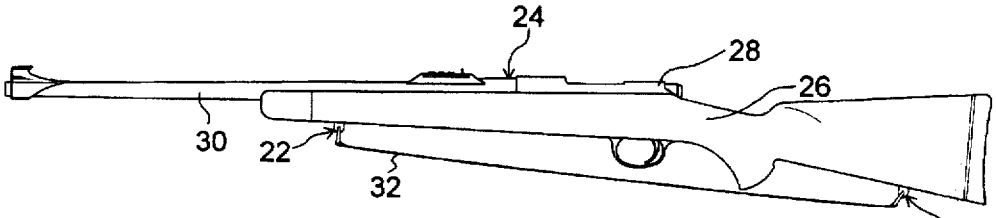
FIG. 1 - Prior Art
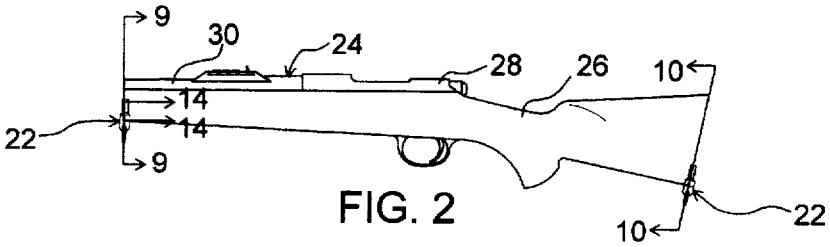
FIG. 2
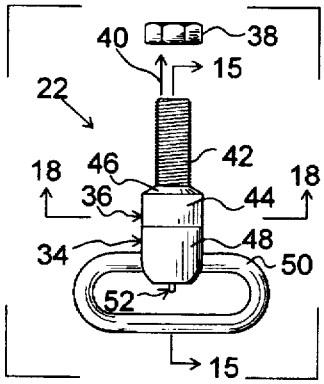
FIG. 3
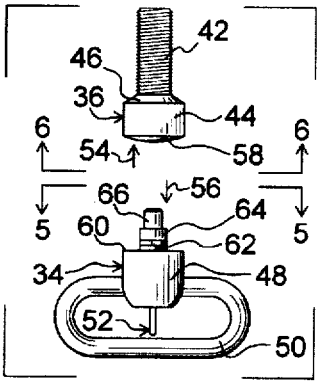
FIG. 4
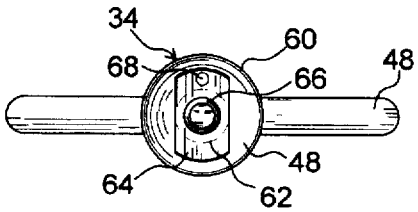
FIG. 5
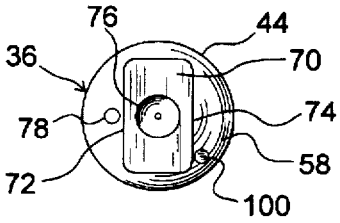
FIG. 6
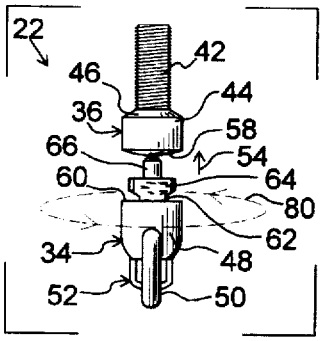
FIG. 7
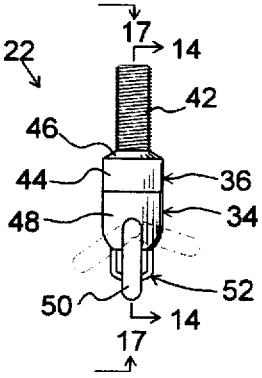
FIG. 8

SLING AND ACCESSORY ATTACHMENT SYSTEM

BACKGROUND OF THE INVENTION

This invention relates generally to a sling attachment device and more specifically to a new and novel sling and accessory attachment system. The new and novel sling and accessory attachment system is designed to be used with a variety of objects that are carried by a sling or carry strap such as firearms, cameras, and similar objects. The new and novel sling and accessory attachment system is also designed to allow attachment of a bipod, tripod and other accessories to an object such as a firearm or camera.

On prior art firearms, such as rifles and shotguns, there are spaced apart attachment points, commonly known as gun sling swivels, used for attaching a sling or carry strap, which are positioned in the gun stock, on single piece stocks, at a position near the barrel on the bottom of the forearm and at a second position on the rearward portion on the bottom of the stock near the butt. In two part stocks, the sling attachment is placed at the lower rearward position of the butt stock and at a forward position on the magazine or attached to the barrel. A sling or carry strap is threaded through loop portions of prior art sling attachment devices and extends from one to the other and rejoins itself with a clasp or buckle to form a secured unit. Accessories, primarily bipods, are attached to the forearm or forward end of the firearm and are used in steadying a firearm during shooting, or as a portable stand when the firearm is not in use.

While there are a wide variety of gun sling swivels, and variations of gun sling swivels as illustrated in the U.S. Pat. No. 4,841,658, design problems in these types of gun sling swivels present several disadvantages. Protruding posts that extend above the surface of a gun stock scratch and disfigure shooting rests, furniture, and other surfaces. Specialized tools have made installation of these prior art gun sling swivels impractical for the average person to self install and are relatively expensive to purchase. Some of the more common types of prior art gun sling swivels involve several moving parts resulting in noisy joints and swivel parts that fall against gun stock surfaces causing blemishes. In some cases, other prior art systems have become inadvertently disconnected or are incompletely connected causing a gun to fall, creating a dangerous situation. By design, some other systems are nearly impossible to remove without causing severe damage to the gun stock or to the swivel itself and others are known for cracking the finish and splitting the gun stock.

SUMMARY OF THE INVENTION

To overcome the before described considerations and problems inherent in and encountered with prior art swivel attachments, there is provided by the subject invention a unique detachable sling and accessory attachment system that quickly and easily connects and disconnects allowing the user to utilize slings and other accessories, such as bipods, with a prior art object such as a rifle, shotgun or camera. The new and novel sling and accessory attachment system is also designed to be securely locked in place on the prior art object. Additionally, the new and novel sling and accessory attachment system is further designed to be easily installed into or removed from a firearm stock or other object without special tools.

The new and novel sling and accessory attachment system is comprised of two basic members. An anchor means, which is attached to a gun stock or other device, is seated flush with the gun stock surface and is internally formed to receive, and lock in place, a removable external attaching member. The attaching member has formed thereon a pilot shaft for guiding and locating the attaching member in the anchor means and a locking lug which locks the attaching member in an inner radial channel formed within the anchor means. The removable attaching member also houses a clevis pin which locks the attaching member and the anchor means together as a unit by sliding a clevis pin bolt through a first bore in the anchor means and into a hole formed in the locking lug of the attaching member. The clevis pin can be retracted into an unlocked position allowing the removable attaching member to rotate to a disengaged position where it can be removed from the anchor means, leaving the anchor means flush with the surface of a gun stock without protruding posts that can snag or scratch contacted surfaces.

The removable attaching member also has formed therein loop or accessory bores that pivotally accept a loop for holding a sling or an accessory. In another embodiment a modified removable attaching member has an accessory adapter seat formed on the sides of the modified attaching member. The accessory adapter seat compliments the loop or accessory bores and allows the modified attaching member to be interchangeable and inter-functional with the attaching member and anchor means while allowing the sling and accessory attachment system to be utilized with a variety of accessories such as bipods, tripods and other accessories.

The new and novel sling and accessory attachment system is also designed for ease of installation and removal. Since the relative size and form of the new and novel sling and accessory attachment system is smaller and is provided with a seating surface and threaded shank, commonly available tools can be used to install or remove the new and novel sling and accessory attachment system, negating the need for expensive professional fitting, specialized equipment or cementing the sling and accessory attachment system in place. For example, removal of the new and novel invention sling and accessory attachment system for refinishing a gun stock of a firearm is accomplished by simply turning it out of the gun stock. This feature negates the need for high heat or machining to remove the swivel as required by some prior art devices.

Additionally, the new and novel sling and accessory attachment system is compact, with formed outer surfaces, which result in reduced weight and fewer moving parts. Pre-formed and finished surfaces eliminate secondary contouring and subsequent plating requirements. Compactness is accomplished by eliminating additional linkages resulting in the elimination of sources of undesirable noise and additional weight.

To achieve the foregoing and other advantages, the present invention provides a new and detachable novel sling and accessory attachment system that quickly and easily connects and disconnects, can be securely locked in place and is easily installed and removed. The present invention is also further designed to be compact and lightweight.

The more important features of the present invention have been broadly outlined in order that the detailed description thereof that follows may be better understood and in order that the present contribution to the art may be better appreciated. There are additional features of the invention that will be more fully described hereinafter and which, together with the features outlined above, will form the subject matter of the claims appended hereto. Those skilled in the art will appreciate that the conception, upon which the present disclosure is based, may readily be utilized as a basis for the designing of other structures, methods and systems for carrying out the several purposes of the present invention. It is important, therefore, that the claims be regarded as including such equivalent construction insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory review the nature and essence of the technical disclosure of the application. The abstract is neither intended to define the invention of the application, which is measured by the claims, nor is it intended to be limiting as to the scope of the invention in any way.

Accordingly, it is an object and advantage of the invention to provide a new and novel sling and accessory attachment system that quickly and easily connects and disconnects.

Another object and advantage of the invention is to provide a new and novel sling and accessory attachment system that may be used with a variety of slings, accessories and other attachments.

Another object and advantage of the invention is to provide a new and novel sling and accessory attachment system that securely locks in place.

Another object and advantage of the invention is to provide a new and novel sling and accessory attachment system that is compact and lightweight.

Another object and advantage of the invention is to provide a new and novel sling and accessory attachment system that reduces undesirable noise.

Another object and advantage of the invention is to provide a new and sling and accessory attachment system that is easily installed and removed.

Another object and advantage of the invention is to provide a new and novel sling and accessory attachment system that is interchangeable and inter-functional.

Still another object and advantage of the invention is to provide a new and novel sling and accessory attachment system which may be easily and efficiently manufactured and marketed.

Yet another object and advantage of the invention is to provide a new and novel sling and accessory attachment system which is of durable and reliable construction.

These and other objects and advantages will become apparent from review of the drawings and from a study of the Description of the Preferred Embodiment relating to the drawings which has been provided by way of illustration only.

BRIEF DESCRIPTION OF THE DRAWINGS

FIG. 1 is a side view of the new and novel sling and accessory attachment system in position on a prior art firearm.

FIG. 2 is a sectioned side view of the new and novel sling and accessory attachment system in position on a prior art firearm.

FIG. 3 is a front view of the new and novel sling and accessory attachment system.

FIG. 4 is an exploded front view of the new and novel sling and accessory attachment system.

FIG. 5 is an end view of the attaching member of the new and novel sling and accessory attachment system taken along lines 5—5 of FIG. 4 of the drawings.

FIG. 6 is an end view of the anchor means of the new and novel sling and accessory attachment system taken along lines 6—6 of FIG. 4 of the drawings.

FIG. 7 is an exploded side view of the new and novel sling and accessory attachment system.

FIG. 8 is a side view of a fully engaged but unlocked sling and accessory attachment system.

DESCRIPTION OF THE PREFERRED EMBODIMENT

Figure 9:
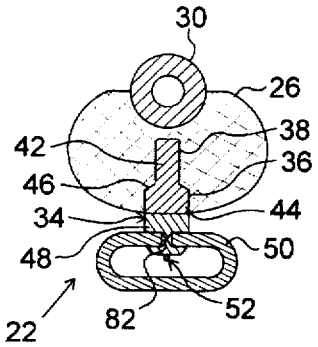
FIG. 9 is a sectional view of the new and novel sling and accessory attachment system in a stock portion of a prior art firearm taken along lines 9—9 of FIG. 2 of the drawings.

Referring to the drawings in general, the present description is given in the context of the new and novel sling and accessory attachment system as utilized with a prior art firearm. It will be readily apparent to those skilled in the art that the usefulness of the present invention is not limited to this application and that changes could be made in construction and should be considered to be within the spirit and scope of the present invention.

Referring now in particular to FIG. 1 of the drawings, there is shown the new and novel sling and accessory attachment system, shown generally by the numeral 22, in position on a prior art firearm shown generally by the numeral 24. A typical prior art firearm 24 may have a stock 26, an action 28, a barrel 30 and a sling 32. The prior art firearm 24 is shown in the Preferred Embodiment and in FIG. 1 of the drawings for purposes of illustration only. The new and novel sling and accessory attachment system 22 has been designed to be utilized with a variety of prior art objects such as firearms, cameras, and similar objects.

Referring now to FIG. 2 of the drawings there is shown a sectioned side view of the new and novel sling and accessory attachment system 22 in position on a prior art firearm 24. FIG. 2 illustrates the positioning and orientation of the attachment system 22 in the substrate of the stock 26, the foremost and rearmost portions of the stock 26 having been removed for purposes of clarity. The sling and accessory attachment system 22 is medially located on an underside of the stock 26, a portion of the attachment system 22 being embedded in the stock 26.

Referring now to FIG. 3 of the drawings there is shown a front view of the new and novel sling and accessory attachment system 22. The attachment system 22 illustrated in FIG. 3 of the drawings is in a closed and locked position. The attachment system 22 has an attaching member, shown generally by the numeral 34, removably attached to an anchor means, shown generally by the numeral 36. Anchor means 36 removably engages retaining means 38 in the direction of the arrow 40. The retaining means 38 is embedded into the stock 26 of a typical prior art firearm 24, the stock 26 and the prior art firearm 24 not shown in FIG. 3 of the drawings for purposes of clarity. Similarly, the retaining means 38 may be embedded in a suitable portion of a camera and similar objects, also not shown in FIG. 3 of the drawings. In the Preferred Embodiment, the retaining means 38 is a threaded nut as shown in FIG. 3. In another embodiment, the retaining means 38 is integrally formed as part of a body of an object, such as the stock 26 of a prior art firearm 24, or, in the case of a camera, formed in the body of the camera. For example, the retaining means 38 may be a threaded bore formed in the stock 26 of a prior art firearm 24 or a threaded bore formed in the body of a camera. Other retaining means known in the art may also be used and are considered to be within the spirit and scope of the present invention.

Anchor means 36 has retaining means engaging member 42 longitudinally and distally formed on anchor head portion 44. The anchor head portion 44 of the anchor means 36 has seating face surface 46 formed on an outer perimeter of the anchor head portion 44 near the retaining means engaging member 42. In the Preferred Embodiment, the retaining means engaging member 42 is threaded and has been designed to removably engage the retaining means 38, thereby removably securing the anchor means 36 to the retaining means 38 and thus, removably securing the anchor means 36 to the stock 26 of a prior art firearm 24, the prior art firearm 24 not shown in FIG. 3 of the drawings for purposes of clarity. Other engaging members known in the art, which will securely and removably engage various types of retaining means 38 known in the art, may also be used and are considered to be within the spirit and scope of the present invention.

Attaching member 34 also has an attaching head portion 48, the attaching head portion 48 of the attaching member 34 being designed to dock with the anchor head portion 44 of the anchor means 36 as will be discussed more fully hereinafter. Loop 50 is movably mounted in the attaching head portion 48 of the attaching member 34. A clevis pin, shown generally by the numeral 52, is centrally and longitudinally disposed through the attaching head portion 48 of the attaching member 34. The loop 50 and the clevis pin 52 will be discussed more fully hereinafter.

Referring now to FIG. 4 of the drawings there is shown an exploded front view of the new and novel sling and accessory attachment system 22. The attachment system 22 illustrated in FIG. 4 of the drawings is in an opened and unlocked position. Anchor means 36 and attaching member 34 are engaged and disengaged in the direction of the arrows 54 and 56 respectively.

Figure 10:
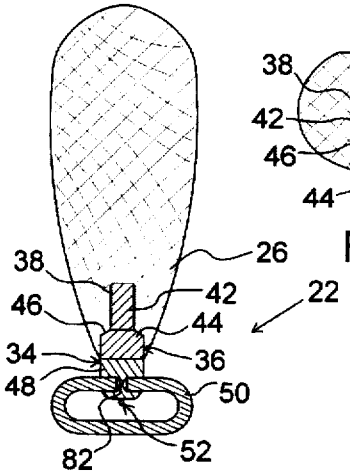
FIG. 10 is a sectional view of the new and novel sling and accessory attachment system in a stock portion of a prior art firearm taken along lines 10—10 of FIG. 2 of the drawings.
Figure 11:
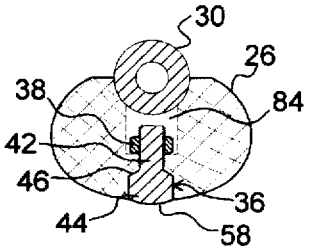
FIG. 11 is a sectional view of the new and novel sling and accessory attachment system in a stock portion of a prior art firearm taken along lines 11—11 of FIG. 2 of the drawings.
Figure 12:
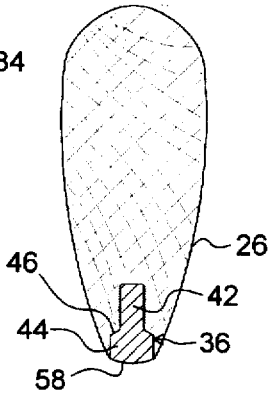
FIG. 12 is a sectional view of the new and novel sling and accessory attachment system in a stock portion of a prior art firearm taken along lines 12—12 of FIG. 2 of the drawings.

Crown 58 is formed on attaching head portion 48 of the anchor means 36 opposite seating face surface 46 and has been designed to lie flush with the stock 26 surface of a prior art firearm 24, not shown in FIG. 4 but clearly seen in FIGS. 1 and 2 of the drawings. Referring briefly to FIGS. 11 and 12, it can be seen that the crown 58 of the anchor means 36 does not protrude above the surface of the gun stock 26 of the prior art firearm 24, thereby eliminating "snag surfaces". The retaining means engaging member 42 is designed to pull the seating face surface 46 of the anchor means 36, and thus the anchor means 36 itself, tightly against the stock 26 of the prior art firearm 24 as shown in FIGS. 11 and 12. Once the anchor means 36 is removably secured in the stock 26 of the prior art firearm 24, the attaching member 34 can be inserted to complete the sling and accessory attachment system 22 as shown in FIGS. 9 and 10.

Referring back to FIG. 4 of the drawings, there is shown a skirt 60 formed around the perimeter of the attaching head portion 48 of the attaching member 34 and opposite the loop 50. The skirt 60 has been designed to dock with the crown 58 of the anchor means 36 and to shield the inner components of the sling and accessory attachment system 22. A main shaft 62 is centrally formed on the attaching head portion 48 of the attaching member 34 opposite the loop 50, the main shaft 62 being centrally located within skirt 60. Locking lug 64 is formed on the main shaft 62 and pilot shaft 66 is formed on locking lug 64, the pilot shaft 66 being an integral part of the main shaft 62 and extending beyond the locking lug 64. Clevis pin 52 is also shown in FIG. 4 of the drawings, the clevis pin 52 being shown in an extended, unlocked position.

Referring now to FIG. 5 of the drawings there is shown an end view of the attaching member 34, taken along lines 5—5 of FIG. 4 of the drawings. FIG. 5 shows the configuration of skirt 60 around the perimeter of the attaching head portion 48 of the attaching member 34 and the configuration of locking lug 64. In the Preferred Embodiment, the locking lug 64 has been designed having opposing flanges or wings. Other designs and other locking lug configurations known in the art may also be used and are considered to be within the spirit and scope of the present invention. A portion of the locking lug 64 has a bore or hole 68 formed therein, the hole 68 being designed to receive a portion of clevis pin 52, the clevis pin 52 not shown in FIG. 5 for purposes of clarity. The disposition of the clevis pin 52 through the hole 68 of the locking lug 64 will be discussed more fully hereinafter.

Referring now to FIG. 6 of the drawings there is shown an end view of the anchor means 36, taken along lines 6—6 of FIG. 4 of the drawings. Locking lug receiving window 70 is centrally and longitudinally formed in anchor head portion 44 of anchor means 36. Locking lug retaining means 72 and 74 are integrally formed from crown 58 on either side of the locking lug receiving window 70 and have been designed to retain locking lug 64 in the anchor head portion 44 of the anchor means 36. Pilot shaft bore 76 is centrally located at the bottom of the locking lug receiving window 70 within anchor head portion 44 of the anchor means 36. The pilot shaft bore 76 guides the pilot shaft 66 and the attaching member 34 into the proper position in the anchor means 36, the pilot shaft 66 and the attaching member 34 are not shown in FIG. 6 for purposes of clarity.

First bore 78 is formed through the anchor head portion 44 of the anchor means 36 and has been designed to receive a portion of the clevis pin 52. Rotational stop 100 is also shown in FIG. 6 of the drawings and is longitudinally oriented within the anchor head portion 44 of the anchor means 36. The disposition and function of clevis pin 52 and rotational stop 100 will be discussed more fully hereinafter.

Referring now to FIG. 7 of the drawings there is shown an exploded side view of the sling and accessory attachment system 22. Attaching member 34 is inserted into anchor means 36 in the direction of the arrow 54. The attaching member 34 is then rotated in the direction of the arrow 80 the anchor means 36 thereby removably engaging the attaching member 34. The clevis pin 50 can then be pushed into the attaching member 34 and, thus, into anchor means 36, thereby removably locking the attaching member 34 to the anchor means 36 and completing a fully engaged and locked attachment system 22.

Referring now to FIG. 8 of the drawings there is shown a side view of a fully engaged but unlocked attachment system 22. Clevis pin 52 has not been fully pushed into the attachment system 22 in FIG. 8. FIG. 8 of the drawings illustrates the pivotally movable nature of the loop 50, alternate positions being shown in dot-dash lines for purposes of clarity. The loop 50 may be moved to any number of alternate positions and is not limited to those alternate positions shown in FIG. 8 of the drawings which are provided for purposes of illustration only.

Referring now in general to FIGS. 9–12 of the drawings there are shown sectional views of a stock 26 of a prior art firearm 24 having a sling and accessory attachment system 22 attached thereto. FIG. 9 is taken along lines 9—9 of FIG. 2 of the drawings and FIG. 10 is taken along lines 10—10 of FIG. 2 of the drawings. FIG. 11 is taken along lines 11—11 of FIG. 2 of the drawings and FIG. 12 is taken along lines 12—12 of FIG. 2 of the drawings.

FIGS. 9 and 10 illustrate the positioning of the anchor means 36 within the stock 26 of a prior art firearm and the orientation of the attaching member 34 to the anchor means 36 when the attaching member 34 is fully engaged by and locked into anchor means 36. FIGS. 9 and 10 also illustrate another embodiment of the retaining means 38 in which the retaining means 38 is integrally formed as part of the stock 26 of a prior art firearm. In this embodiment, and as shown in FIGS. 9 and 10, the retaining means 38 is a threaded bore formed in the stock 26 of a prior art firearm. Other retaining means known in the art may also be used and are considered to be within the spirit and scope of the present invention. FIGS. 9 and 10 also show loop or accessory bores 82 formed in attaching head portion 48 of the attaching member 34.

FIGS. 11 and 12 are sectional views similar to FIGS. 9 and 10 except that the attaching member 34 has been removed from the sling and accessory attachment system to illustrate how the crown 58 of the anchor means 36 lies flush with the stock 26 of a prior art firearm. In the Preferred Embodiment, retaining means 38 is a threaded nut embedded in the stock 26 of a typical prior art firearm as shown in FIG. 11 of the drawings. A counter-bore 84 may be present in the gun stock 26, the counter-bore 84 allowing access to the retaining means 38 and to the retaining means engaging member 42 without interfering with the seating of a barrel 30 on a gun stock 26. Retaining means 38 may be similarly embedded in a suitable portion of a camera and similar objects on which the sling and accessory attachment system 22 may be used.

Figure 13:
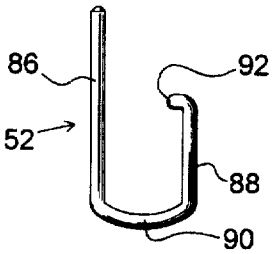
FIG. 13 is a plan view of a clevis pin of the new and novel sling and accessory attachment system.

Referring now in general to FIGS. 13–16 of the drawings there will be described in detail the inner components of the anchor means 36 and engagement of the attaching member 34 to the anchor means 36 of the sling and accessory attachment system 22. Referring now in particular to FIG. 13, there is shown a plan view clevis pin 52. The clevis pin 52 has clevis pin bolt or bolt 86 and clevis pin arm or arm 88 oppositely formed on clevis pin handle or handle 90. Detent nose 92 is formed on arm 88 opposite handle 90 of clevis pin 52. Clevis pin 52 is constructed to have a spring-like nature, the spring action being in the arched clevis pin handle 90 and exerting spring-like pressure toward bolt 86 such that detent nose 92 is urged toward bolt 86 of the clevis pin 52.

Figure 14:
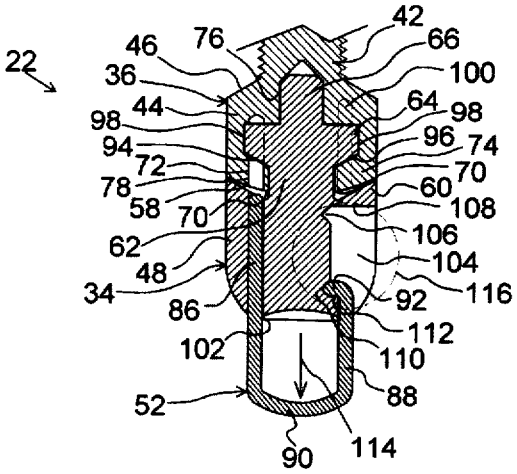
FIG. 14 is a sectional view of the new and novel sling and accessory attachment system in an engaged, unlocked position, taken along lines 14—14 of FIG. 8 of the drawings.

Referring now to FIG. 14 of the drawings, there is shown the sling and accessory attachment system 22 in an engaged, unlocked position. FIG. 14 is sectional view taken along lines 14—14 of FIG. 8 of the drawings. The loop 50 is not shown in FIG. 14 for purposes of clarity. Locking lug retaining means 72 and 74 are formed in the anchor head portion 44 of the anchor means 36, the locking lug retaining means 72 and 74 having locking lug seat surfaces 94 and 96 opposite crown 58. Inner radial channel 98 is formed in the anchor head portion 44 of the anchor means 36, the inner radial channel 98 being generally circular in shape and concentric to the outer circumference of the anchor head portion 44 of anchor means 36. The inner radial channel 98 is positioned between locking lug retaining means 72 and 74 and that portion of the anchor head portion 44 which lies adjacent to the opening of the pilot shaft bore 76. Stated another way, the inner radial channel 98 lies between the locking lug retaining means 72 and 74 and the pilot shaft bore 76. The inner radial channel 98 has been designed to receive the locking lug 64 of the attaching member 34 and has also been designed to allow the locking lug 64 to rotate within the anchor head portion 44 of the anchor means 36.

Rotational stop 100, shown in dashed lines for purposes of clarity, is positioned in the inner radial channel 98 providing a contact point for the locking lug 64. The rotational stop 100 is positioned so that the locking lug 64 will be perpendicularly oriented to the locking lug receiving window 70 when locking lug 64 contacts the rotational stop 100. Thus, the locking lug 64 of the attaching member 34 is retained within inner radial channel 98 of the anchor means 36 between the locking lug retaining means 72 and 74 and that portion of the anchor head portion 44 of the anchor means 36 which lies adjacent to the pilot shaft bore 76 thereby engaging the attaching member 34 in the anchor means 36.

Clevis pin 52 is shown in FIG. 14 of the drawings in an unlocked position. The clevis pin bolt or bolt 86 of clevis pin 52 is disposed in second bore 102 in the attaching head portion 48 of attaching member 34. Clevis pin arm or arm 88 with detent nose 92 is oppositely disposed in guide slot 104 in the attaching head portion 48 of attaching member 34. Guide slot 104 has formed therein lock detent 106, lock stop 108, release detent 110 and release stop 112. In the unlocked position, as shown in FIG. 14, detent nose 92 of clevis pin 52 seats in release detent 110. Release stop 112 limits release travel of the clevis pin 52 when the clevis pin 52 is pulled in the direction of the arrow 114 and prevents loss of the clevis pin 52 from the attaching member 34. Details of guide slot 104 are further illustrated in the enlarged view of FIG. 16 of the drawings, the view indicated by the dashed circle 116 in FIG. 14, and will be further discussed hereinafter.

Figure 15:
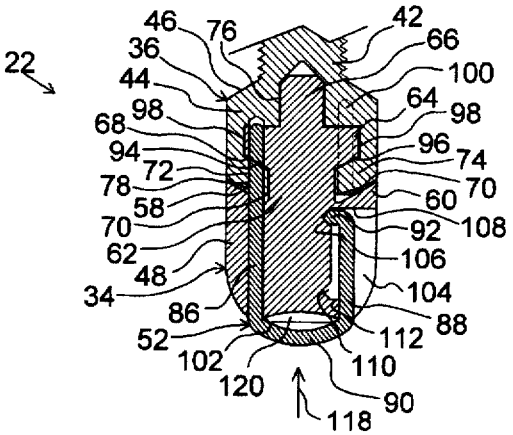
FIG. 15 is a sectional view of the new and novel sling and accessory attachment system in an engaged, locked position, taken along lines 15—15 of FIG. 3 of the drawings.

Referring now to FIG. 15 of the drawings, there is shown the sling and accessory attachment system 22 in an engaged, locked position. FIG. 15 is sectional view taken along lines 15—15 of FIG. 8 of the drawings. The loop 50 is not shown in FIG. 15 for purposes of clarity. In the locked position, the clevis pin handle or handle 90 is pushed in the direction of the arrow 118. This causes the clevis pin bolt or bolt 88 of clevis pin 52 to enter first bore 78 in anchor head portion 44 of anchor means 36 and to enter hole 68 in locking lug 64, removably securing locking lug 64 in a locked position, thereby preventing rotation of locking lug 64 and disengagement of attaching member 34 from anchor means 36.

Additionally, the clevis pin arm or arm 88 simultaneously moves detent nose 92 into lock detent 106 where detent nose 92 seats into lock detent 106, due to the spring like nature of clevis pin 52 as previously described, thereby removably securing clevis pin 52 in a locked position in the sling and accessory attachment system 22. Lock stop 108 prevents detent nose 92 from being pushed too far into attaching head portion 48 of attaching member 34 and thus, properly seats detent nose 92 into lock stop 108.

Clevis pin handle access 120 is formed in anchor head portion 44 of attaching member 34 so that the clevis pin handle or handle 90 is easily accessible. When the attaching member 34 is in an engaged and locked position, the clevis pin handle 90, which is accessible through the clevis pin handle access 120, is gripped and pulled in the direction of the arrow 114 as shown in FIG. 14 of the drawings. This releases the locking lug 64 and allows rotation of the attaching member 34, and of the locking lug 64, within the anchor head portion of anchor means 36. Since the rotation of the attaching member 34 aligns the locking lug 64 with locking lug receiving window 70, the attaching member 34 can then be removed from the anchor means 36. When the attaching member 34 is to be attached to the anchor means 36, the pilot shaft 66 followed by locking lug 64 and then by main shaft 62, is inserted into the anchor means 36 through the locking lug receiving window 70 and rotated until the locking lug 64 contacts the rotational stop 100, thereby aligning the hole 68 of the locking lug 64 with the second bore 102 in the anchor head portion 44 of the anchor means 36. The clevis pin handle 90 is then pushed into the clevis pin handle access 120 in the direction of the arrow 118, which simultaneously pushes the clevis pin bolt 86 through the first bore 78 of the anchor means 36 and into the hole 68 of the locking lug 64, and which also simultaneously pushes the detent nose 92 of the clevis pin arm 88 into the lock detent 106, thereby engaging and locking the attaching member 34 to the anchor means 36.

Figure 16:
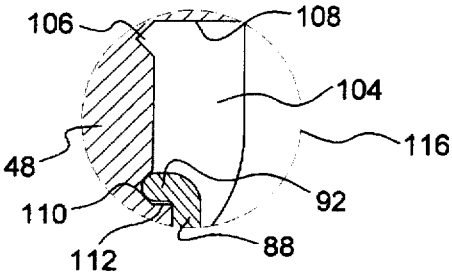
FIG. 16 is an enlarged view of the guide slot in a portion of the new and novel sling and accessory attachment system.

Referring now to FIG. 16 of the drawings there is shown in detail the locking and releasing mechanism of the detent nose 92 of clevis pin 52 within guide slot 104. FIG. 16 is an enlarged view of the guide slot 104 shown in FIG. 14 by the dashed circle 116. Still referring to FIG. 16 of the drawings, there is shown detent nose 92 in an unlocked position, the detent nose 92 being seated in release detent 110 and held in place by the spring-like force of the clevis pin 52. Guide slot 104 has been designed to retain and guide arm 88 with detent nose 92 of clevis pin 52 within head portion 48 of attaching member 34.

Figure 17:
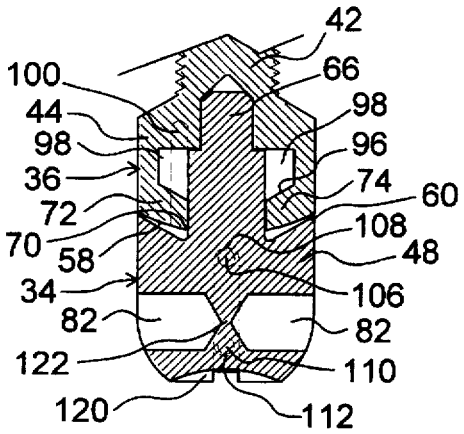
FIG. 17 is a sectional view of the new and novel sling and accessory attachment system taken along lines 17—17 of FIG. 8 of the drawings.

Referring now to FIG. 17 of the drawings there is shown a sectional view of the new and novel sling and accessory attachment system 22 taken along lines 17—17 of FIG. 8 of the drawings. Loop 50 and clevis pin 52 are not shown in FIG. 17 for purposes of clarity. Loop or accessory bores 82 are clearly shown in FIG. 17 of the drawings as well as loop stop 122. Loop or accessory bores 82 receive ends of a loop 50 or ends of other accessory attachments. Loop stop 122 is formed within attaching head portion 48 of attaching member 34 between loop bores 82 to hold ends of a loop 50 in position within the attaching head portion 48 while allowing pivotal movement of ends of a loop 50 within loop bores 82 and thus, allowing pivotal movement of a loop 50 about attaching head portion 48 of the attaching member 34.

FIG. 17 of the drawings also illustrates and better defines the inner radial channel 98 formed within anchor head portion 44 of anchor means 36. In FIG. 17, the flanges or wings of locking lug 64 are perpendicular to the plane of the sectional view, and therefore not visible in this view, illustrating the open nature of the inner radial channel 98 in which the locking lug 64 rotates.

Figure 18:
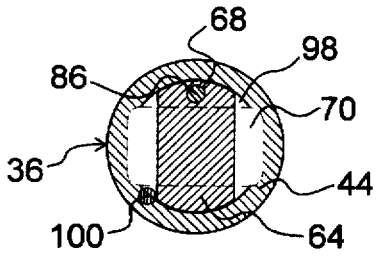
FIG. 18 is a sectional view of the anchor means of the new and novel sling and accessory attachment system taken along lines 18—18 of FIG. 3 of the drawings.

Referring now to FIG. 18, there is shown a sectional view of anchor means 36 taken along lines 18—18 of FIG. 3 of the drawings. FIG. 18 illustrates the position of locking lug 64 within the anchor head portion 44 of anchor means 36 when locking lug 64 is engaged in anchor means 36. In this position, locking lug 64 contacts rotational stop 100 and is perpendicular to locking lug receiving window 70, the locking lug receiving window 70 shown in dashed lines for purposes of clarity. Hole 68, in locking lug 64, is in vertical alignment with first bore 78, the first bore 78 not seen in FIG. 18 but clearly shown in FIGS. 6, 14 and 15, thereby allowing clevis pin bolt 86 to be moved into hole 68, securing locking lug 64 from rotational movement.

Figure 19:
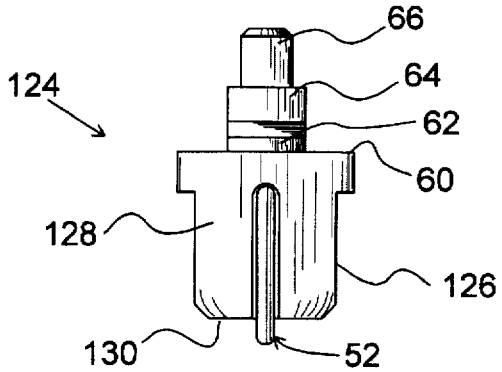
FIG. 19 is a side view of a modified attaching member of the new and novel sling and accessory attachment system.
Figure 20:
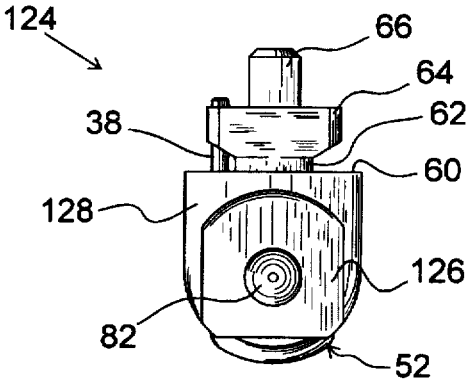
FIG. 20 is a front view of a modified attaching member of the new and novel sling and accessory attachment system.

Referring now in general to FIGS. 19 and 20 of the drawings there will be described a modification of the sling and accessory attachment system 22 which allows the new and novel invention to be used with a wide variety of accessories. Referring now in particular to FIG. 19 of the drawings, there is shown a side view of a modified attaching member 124. Accessory adapter seat 126 is formed on the sides of modified attaching member 124. Accessory adapter seat 126 compliments the loop or accessory bores 82 found in the attaching member 34, the loop or accessory bores 82 and the attaching member 34 are not shown in FIG. 19 but are shown in FIGS. 17 and 20 of the drawings.

Still referring to FIG. 19 of the drawings, modified attaching member 124 has a modified attaching head portion 128, the modified attaching head portion 128 having a clevis pin release side 130, a main shaft 62 formed opposite the side 130, locking lug 64 formed on the main shaft 62, and a pilot shaft 66 distally formed on the locking lug 64. The main shaft 62 locking lug 64 and pilot shaft 66 of the modified attaching member 124 are the same as the main shaft 62, locking lug 64 and pilot shaft 66 of the attaching member 34 previously described. Accessory adapter seat 126 is formed on the modified attaching head portion 128 of the modified attaching member 124 and is parallel to and equidistant from the axis of the main shaft 62 and pilot shaft 66. In the Preferred Embodiment, and in FIG. 19 of the drawings, at least two accessory adapter seats 126 are formed on opposite sides of the modified attaching head portion 128 of the modified attaching member 124. Other numbers and configurations of accessory adapter seats known in the art may also be used and are considered to be within the spirit and scope of the present invention.

Referring now to FIG. 20 of the drawings there is shown a front view of modified attaching member 124. Accessory adapter seat 126 is a flat surface formed in the modified attaching head portion 128 of the modified attaching member 124 having loop or accessory bores 82 centrally located and formed in the accessory adapter seat 126. Loop or accessory bores 82 allow the modified attaching member 124 to be interchangeable and inter-functional with attaching member 34 and anchor means 36, attaching member 34 and anchor means 36 not shown in FIG. 20, while allowing the sling and accessory attachment system to be utilized with a variety of accessories such as bipods, tripods and other accessories. FIG. 20 also illustrates the disposition of bolt 86 of the clevis pin 52 through the modified attaching head portion 128 of the modified attaching member 124 and through the locking lug 64, the disposition of the bolt 86 of the clevis pin 52 through the modified attaching head portion 128 being the same as the disposition of the bolt 86 through the attaching head portion 48 of an attaching member 34.

From the above it can be seen that the new and novel sling and accessory attachment system accomplishes all of the objects and advantages presented herein before. Nevertheless it is within the spirit and scope of the invention that changes in the basic sling and accessory attachment system may be made and the Preferred Embodiment and the modifications shown and described herein have only been given by way of illustration.

Having described my invention, I claim:

1. A detachable sling and accessory attachment system for removable attachment to a prior art firearm, camera or other object, the detachable sling and accessory attachment system removably attaching a sling, carry strap, bipod, tripod, or other accessory to the prior art firearm, camera or other object, the detachable sling and accessory attachment system comprising: anchor means having an anchor head portion; retaining means engaging member longitudinally and distally formed on the anchor head portion of the anchor means; a locking lug receiving window formed in the anchor head portion of the anchor means; locking lug retaining means formed adjacent to the locking lug receiving window; an inner radial channel formed within the anchor head portion of the anchor means between the locking lug retaining means and the retaining means engaging member; a pilot shaft bore centrally formed between the inner radial channel and the retaining means engaging member; a first bore disposed through the locking lug retaining means; an attaching member, the attaching member having an attaching head portion, the attaching head portion having a main shaft distally and centrally formed thereon; a locking lug centrally formed on the main shaft, the locking lug having a hole formed therein, wherein the locking lug passes through the locking lug receiving window and rotates in the inner radial channel, the locking lug being removably engaged by the locking lug retaining means; a pilot shaft centrally and longitudinally formed on the locking lug, wherein the pilot shaft guides the locking lug into the anchor means; a second bore disposed through the attaching head portion, the second bore aligning with the first bore in the anchor head portion when the attaching member is inserted into anchor means and rotated to seat the locking lug; a guide slot formed in attaching head portion opposite the second bore; a clevis pin movably disposed through second bore and the guide slot, the clevis pin removably locking the locking lug within the anchor means and removably locking the attaching member to the anchor means when the clevis pin is pushed into the attaching head portion of the attaching member, and; accessory bores formed in the attaching head portion of the attaching member, the accessory bores pivotally receive a loop capable of accepting a sling, carry strap and other accessories.

2. A detachable sling and accessory attachment system for removable attachment to a prior art firearm, camera or other object, the detachable sling and accessory attachment system removably attaching a sling, carry strap, bipod, tripod, or other accessory to the prior art firearm, camera or other object, the detachable sling and accessory attachment system comprising:

a. anchor means having an anchor head portion, the anchor head portion having a crown formed thereon and retaining means engaging member longitudinally and distally formed on the anchor head portion of the anchor means opposite the crown;

b. a locking lug receiving window formed through the crown and into the anchor head portion of the anchor means, the locking lug receiving window having locking lug retaining means formed adjacent thereto and as part of the crown, the locking lug retaining means having a first bore formed therein;

c. an inner radial channel, the inner radial channel being formed within the anchor head portion of the anchor means between the locking lug retaining means and the retaining means engaging member;

d. a pilot shaft bore formed within the anchor head portion of the anchor means, the pilot shaft bore being centrally formed between the inner radial channel and the retaining means engaging member;

e. an attaching member, the attaching member having an attaching head portion, the attaching head portion having a main shaft distally and centrally formed thereon, the main shaft having a locking lug centrally formed thereon opposite the attaching head portion, the locking lug having a hole formed therein, wherein the locking lug passes through the locking lug receiving window and can be rotated in the inner radial channel, the locking lug being removably engaged by the locking lug retaining means;

f. a pilot shaft centrally and longitudinally formed on the locking lug opposite the main shaft, wherein the pilot shaft guides the locking lug into the inner radial channel of the anchor means;

g. a second bore disposed through the attaching head portion, the second bore aligning with the first bore in the anchor head portion when the attaching member is inserted into anchor means and rotated to seat the locking lug;

h. a guide slot formed in attaching head portion opposite the second bore, the guide slot having a lock detent, lock stop, release detent and release stop formed therein, the guide slot and the second bore capable of receiving a clevis pin, the clevis pin having a handle, the handle having a bolt and arm oppositely formed thereon, the arm having a detent nose distally formed thereon opposite the handle, wherein the clevis pin removably locks the locking lug within the anchor means and removably locks the attaching member to the anchor means when the clevis pin is pushed into the attaching head portion thereby disposing the bolt through the hole in the locking lug and by engaging the lock detent in the guide slot, and;

i. accessory bores formed in the attaching head portion of the attaching member, the accessory bores being formed opposite the main shaft, locking lug and pilot shaft, wherein the accessory bores pivotally receive a loop, the loop being capable of accepting a sling, carry strap and other accessories.

3. The detachable sling and accessory attachment system as defined in claim 2 wherein the retaining means engaging member removably engages a prior art object, the retaining means engaging member removably securing the sling and accessory attachment system to the object.

4. The detachable sling and accessory attachment system as defined in claim 3 wherein the retaining means engaging member has threads formed thereon, the threads removably engaging retaining means formed in a prior art object.

5. The detachable sling and accessory attachment system as defined in claim 2 wherein the crown of the anchor head portion lies flush with a prior art surface when the anchor means is removably attached to a prior art object.

6. The detachable sling and accessory attachment system as defined in claim 2 wherein a seating face surface is formed on an outer perimeter of the anchor head portion adjacent to the retaining means engaging member, the retaining means engaging member drawing the seating face surface tightly against a prior art object.

7. The detachable sling and accessory attachment system as defined in claim 2 wherein a rotational stop is formed within the inner radial channel, the rotational stop limiting the rotation of the locking lug to align the hole formed in the locking lug with the first bore disposed through the anchor head portion of the anchor means.

8. The detachable sling and accessory attachment system as defined in claim 2 wherein a skirt is formed on the perimeter of the attaching head portion, the skirt protecting the main shaft, locking lug and pilot shaft of the attaching member.

9. The detachable sling and accessory attachment system as defined in claim 2 wherein a clevis pin handle access is formed between the guide slot and second bore, the clevis pin handle access allowing easy access to the clevis pin handle for release of the clevis from a locked position to an unlocked position.

10. The detachable sling and accessory attachment system as defined in claim 2 wherein the clevis pin handle is arched, the arched handle acting as a spring.

11. The detachable sling and accessory attachment system as defined in claim 2 wherein an accessory adapter seat is formed on a modified attaching head portion of a modified attaching member parallel to and equidistant from the axis of the main shaft and of the pilot shaft, the accessory adapter seat being a flat surface and having accessory bores centrally formed therein, the accessory adapter seat being interchangeable and inter-functional with the attaching member and anchor means, the accessory adapter seat capable of removably attaching bipods, tripods and other accessories to the sling and accessory attachment system.

12. A detachable sling and accessory attachment system for removable attachment to a prior art firearm, camera or other object, the detachable sling and accessory attachment system removably attaching a sling, carry strap, bipod, tripod, or other accessory to the prior art firearm, camera or other object, the detachable sling and accessory attachment system comprising:

a. anchor means having an anchor head portion, the anchor head portion having a crown formed thereon;

b. retaining means engaging member, the retaining means engaging member being longitudinally and distally formed on the anchor head portion of the anchor means opposite the crown;

c. a locking lug receiving window formed through the crown and into the anchor head portion of the anchor means;

d. locking lug retaining means, the locking lug retaining means being formed as part of the crown adjacent to the locking lug receiving window;

e. an inner radial channel, the inner radial channel being formed within the anchor head portion of the anchor means between the locking lug retaining means and the retaining means engaging member;

f. a pilot shaft bore formed within the anchor head portion of the anchor means, the pilot shaft bore being centrally formed between the inner radial channel and the retaining means engaging member;

g. a first bore disposed through the locking lug retaining means;

h. an attaching member, the attaching member having an attaching head portion, the attaching head portion having a main shaft distally and centrally formed thereon;

j. a locking lug centrally formed on the main shaft opposite the attaching head portion, the locking lug having a hole formed therein, wherein the lug passes through the locking lug receiving window and rotates in the inner radial channel, the locking lug being removably engaged by the locking lug retaining means;

k. a pilot shaft centrally and longitudinally formed on the locking lug opposite the main shaft, wherein the pilot shaft is removably disposed in the pilot shaft bore and guides the locking lug into the anchor means;

l. a second bore disposed through the attaching head portion, the second bore aligning with the first bore in the anchor head portion when the attaching member is inserted into anchor means and rotated to seat the locking lug;

m. a guide slot formed in attaching head portion opposite the second bore, the guide slot having a lock detent, lock stop, release detent and release stop formed therein;

n. a clevis pin, the clevis pin having a handle, the handle having a bolt and arm oppositely formed thereon, the arm having a detent nose distally formed thereon, wherein the clevis pin removably locks the locking lug within the anchor means and removably locks the attaching member to the anchor means when the clevis pin is pushed into the attaching head portion thereby disposing the bolt through the hole in the locking lug and by engaging the lock detent in the guide slot, and;

o. accessory bores formed in the attaching head portion of the attaching member, the accessory bores being formed opposite the main shaft, locking lug and pilot shaft, wherein the accessory bores pivotally receive a loop, the loop being capable of accepting a sling, carry strap and other accessories.

13. The detachable sling and accessory attachment system as defined in claim 12 wherein the retaining means engaging member removably engages a prior art object, the retaining means engaging member removably securing the sling and accessory attachment system to the object.

14. The detachable sling and accessory attachment system as defined in claim 13 wherein the retaining means engaging member has threads formed thereon, the threads removably engaging retaining means formed in a prior art object.

15. The detachable sling and accessory attachment system as defined in claim 12 wherein the crown of the anchor head portion lies flush with a prior art surface when the anchor means is removably attached to a prior art object.

16. The detachable sling and accessory attachment system as defined in claim 12 wherein a seating face surface is formed on an outer perimeter of the anchor head portion adjacent to the retaining means engaging member, the retaining means engaging member drawing seating face surface tightly against a prior art object.

17. The detachable sling and accessory attachment system as defined in claim 12 wherein a rotational stop is formed within the inner radial channel, the rotational stop limiting the rotation of the locking lug to align the hole formed in the locking lug with the first bore disposed through the anchor head portion of the anchor means.

18. The detachable sling and accessory attachment system as defined in claim 12 wherein a skirt is formed on the perimeter of the attaching head portion, the skirt protecting the main shaft, locking lug and pilot shaft of the attaching member.

19. The detachable sling and accessory attachment system as defined in claim 12 wherein a clevis pin handle access is formed between the guide slot and second bore, the clevis pin handle access allowing easy access to the clevis pin handle for release of the clevis from a locked position to an unlocked position.

20. The detachable sling and accessory attachment system as defined in claim 12 wherein the clevis pin handle is arched, the arched handle acting as a spring.

21. The detachable sling and accessory attachment system as defined in claim 12 wherein an accessory adapter seat is formed on a modified attaching head portion of a modified attaching member parallel to and equidistant from the axis of the main shaft and of the pilot shaft, the accessory adapter seat being a flat surface and having accessory bores centrally formed therein, the accessory adapter seat being interchangeable and inter-functional with the attaching member and anchor means, the accessory adapter seat capable of removably attaching bipods, tripods and other accessories to the sling and accessory attachment system.

* * * * *